US009447692B1

(12) United States Patent
Liang

(10) Patent No.: US 9,447,692 B1
(45) Date of Patent: Sep. 20, 2016

(54) TURBINE ROTOR BLADE WITH TIP COOLING

(71) Applicant: George Liang, Palm City, FL (US)

(72) Inventor: George Liang, Palm City, FL (US)

(73) Assignee: S&J DESIGN LLC, Jupiter, FL (US)

( * ) Notice: Subject to any disclaimer, the term of this patent is extended or adjusted under 35 U.S.C. 154(b) by 768 days.

(21) Appl. No.: 13/687,009

(22) Filed: Nov. 28, 2012

(51) Int. Cl.
*F01D 5/18* (2006.01)

(52) U.S. Cl.
CPC ..... *F01D 5/187* (2013.01); *F01D 5/186* (2013.01)

(58) Field of Classification Search
CPC ..... F01D 5/18; F01D 5/186; F01D 5/187
See application file for complete search history.

(56) References Cited

U.S. PATENT DOCUMENTS

| | | | | |
|---|---|---|---|---|
| 4,278,400 | A * | 7/1981 | Yamarik et al. | 416/97 R |
| 7,670,113 | B1 * | 3/2010 | Liang | 416/97 R |
| 7,686,580 | B2 * | 3/2010 | Cunha et al. | 416/97 R |
| 7,955,053 | B1 * | 6/2011 | Liang | 416/97 R |
| 8,016,563 | B1 * | 9/2011 | Liang | 416/97 R |
| 2005/0008487 | A1 * | 1/2005 | Lee et al. | 416/97 R |
| 2006/0222493 | A1 * | 10/2006 | Liang | 416/97 R |

* cited by examiner

*Primary Examiner* — Nathaniel Wiehe
*Assistant Examiner* — Cameron Corday
(74) *Attorney, Agent, or Firm* — John Ryznic

(57) ABSTRACT

A turbine rotor blade with a main serpentine flow cooling circuit extending from a leading edge region to a trailing edge region, and a mini serpentine flow cooling circuit in the blade tip region connected between the first and second legs of the main serpentine flow circuit. Exit slots in the trailing edge region are connected to the last leg of the main serpentine flow circuit and to the mini serpentine flow circuit to provide cooling for the trailing edge region.

4 Claims, 3 Drawing Sheets

TURBINE ROTOR BLADE WITH TIP COOLING

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to a turbine rotor blade with tip peripheral cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A turbine rotor blade rotates within a stationary shroud surface (referred to as a blade outer air seal or BOAS) in which a gap is formed between the blade tip and the shroud surface. Hot gas will leak across the blade tip gap due to a positive gap. This hot gas leakage typically over-heats the blade tip and reduces the blade life. The blade tip gap does not remain constant during engine operation due to factors such as different metal properties from the rotor and the blade and casing. The blade tip erosion due to an over-temperature and lack of adequate cooling is more so in the trailing edge region because of the thin airfoil walls. First stage turbine blades are exposed to the highest hot gas stream temperatures and thus the over-temperature problem is more of an issue.

FIG. 1 shows a prior art turbine blade with a three-pass serpentine flow circuit used to provide cooling for the blade. A first leg 11 provides cooling for a leading edge region while a third leg 13 provides cooling for the trailing edge region. The cooling air for the third leg 13 flows first through the first and second legs 11 and 12 where the cooling air is heated. The cooling air in the third leg 13 is mostly discharged out from a row of trailing edge cooling slots 15 with remaining cooling air being discharged out from a tip cooling hole 16 located in the trailing edge region. A tip cooling air hole 14 can also be used in the tip turn channel between the first and second legs 11 and 12 for the cooling of the blade tip and for producing a seal for the tip gap. FIG. 2 shows a flow diagram for the FIG. 1 blade. FIG. 3 shows a cross section top view for the cooling circuit of the FIG. 1 blade.

BRIEF SUMMARY OF THE INVENTION

A turbine rotor blade with a main serpentine flow cooling circuit extending from a leading edge region to a trailing edge region, and a mini serpentine flow cooling circuit in the blade tip region connected between the first and second legs of the main serpentine flow circuit. Exit slots in the trailing edge region are connected to the last leg of the main serpentine flow circuit and to the mini serpentine flow circuit to provide cooling for the trailing edge region.

A low flow cooling circuit can be created by not using any film cooling holes in the leading edge region or along the walls of the airfoil. Trip strips are used along the walls of the channels in order to enhance the heat transfer coefficient from the hot wall surface to the cooling air.

DETAILED DESCRIPTION OF THE INVENTION

The present invention is a turbine rotor blade with a serpentine flow cooling circuit that provides improved cooling for the blade tip region especially in the trailing edge region of the blade. The blade tip region cooling circuit is especially useful for a first stage turbine blade of an industrial gas turbine engine.

Figure 1:
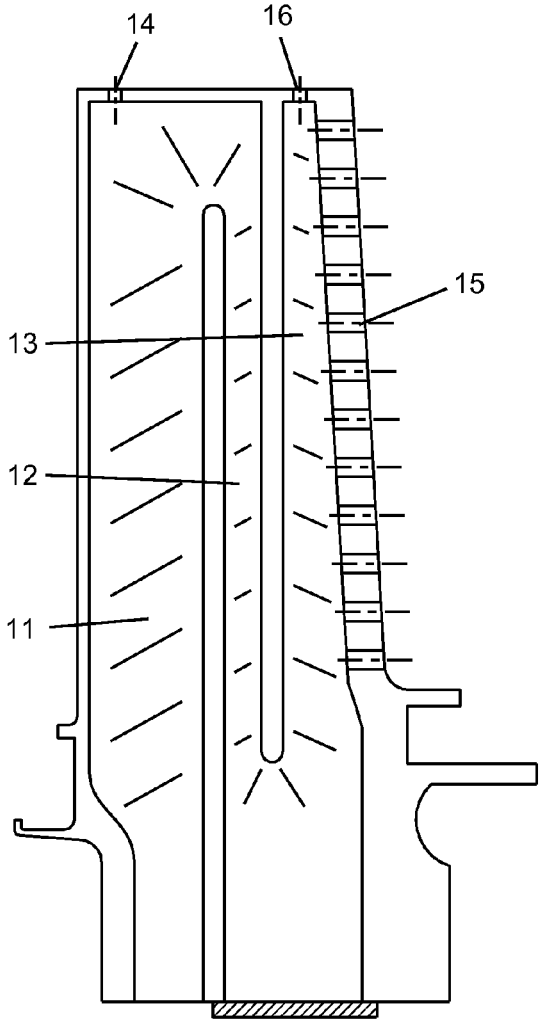
FIG 1 Prior Art
FIG. 1 shows a cross section side view of a prior art turbine blade with a serpentine flow cooling circuit.
Figure 2:
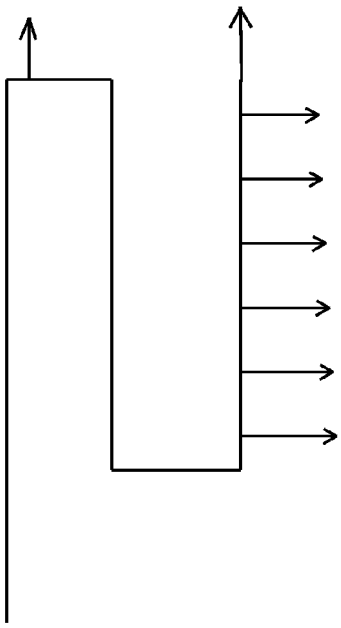
FIG 2 Prior Art
FIG. 2 shows a flow diagram for the prior art FIG. 1 turbine blade.
Figure 3:
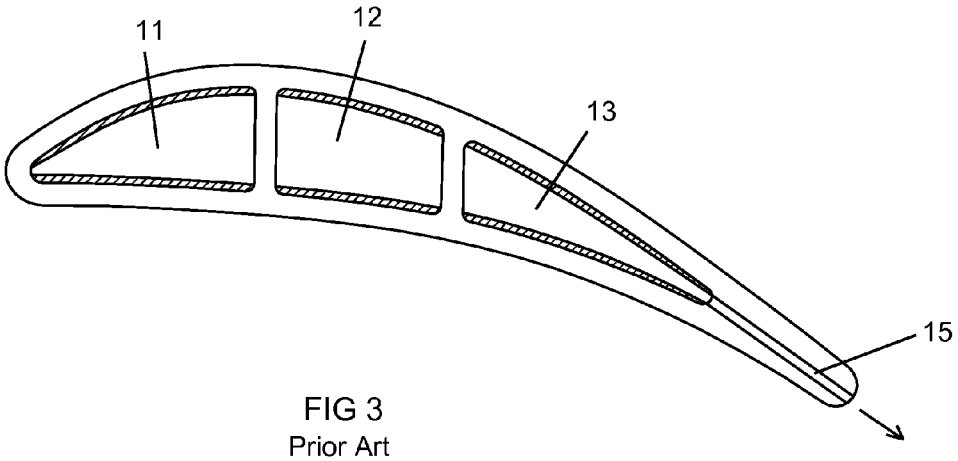
FIG 3 Prior Art
FIG. 3 shows a cross section top view for the cooling circuit of the prior art FIG. 1 turbine blade.
Figure 4:
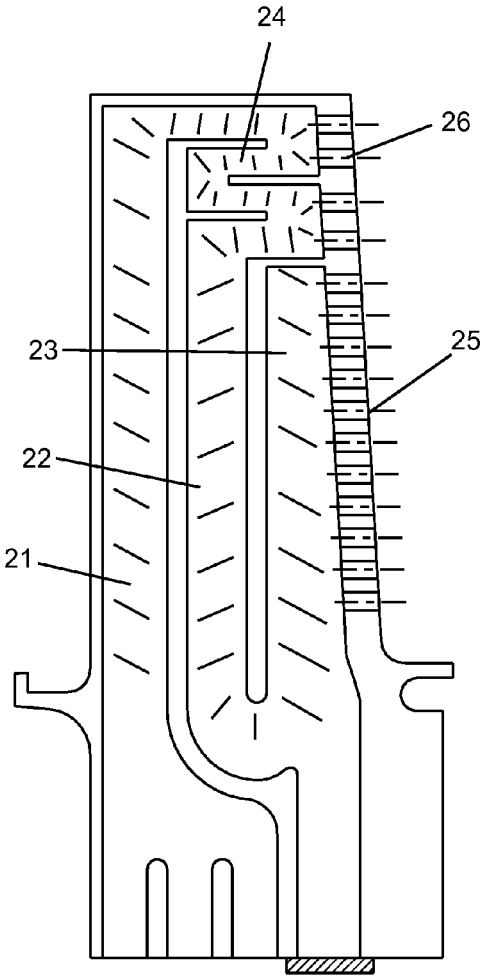
FIG. 4 shows a cross section side view of a turbine blade with a serpentine flow cooling circuit of the present invention.
Figure 5:
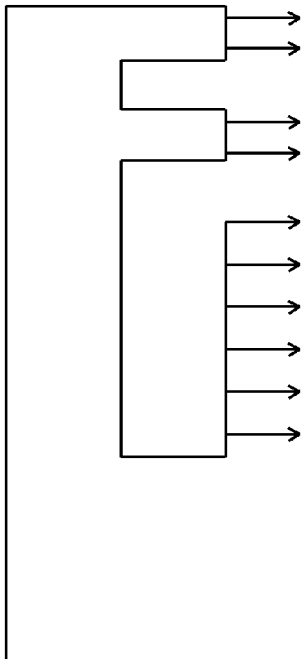
FIG. 5 shows a flow diagram for the cooling circuit of the FIG. 4 turbine blade of the present invention.

FIG. 4 shows a turbine blade with a serpentine flow cooling circuit of the present invention that includes a serpentine flow cooling circuit with a first leg 21, a second leg 22 and a third leg 23. A blade tip serpentine flow cooling circuit 24 with channels and tip turns is located in the blade tip section in the trailing edge region that is connected between the first leg 21 and the second leg 22 of the serpentine flow circuit in order to use cooler air than in the FIG. 1 prior art blade cooling circuit. In the FIG. 4 design, the cooling air used for the tip region is straight from the first leg 21 and flows into the second and third legs 22 and 23 after cooling of the tip region. The cooling air from the third leg 23 is gradually discharged out a row of exit slots 25 arranged along the trailing edge region of the blade, typically on the pressure side wall. However, exit cooling holes opening on the trailing edge of the airfoil can also be used. Trip strips are also used along the walls of the serpentine flow channels or legs to enhance the heat transfer rate from the hot metal walls and into the cooling air flow.

In the present embodiment, no film cooling holes are used in the leading edge region or on the pressure or suction side walls in order to produce a low flow cooling circuit. All of the cooling air will flow through the airfoil except that which is discharged out through the trailing edge exit slots 25 and 26. However, film cooling holes could be used if required in order to limit metal temperatures around the airfoil.

In operation, cooling air flows up the first leg 21 to provide cooling air for the leading edge region of the blade where the highest heat loads are found. The cooling air then flows along a blade tip region channel to provide cooling for this section of the blade, and then serpentines along the serpentine channels in the blade tip region to provide cooling for this section of the blade that typically over-heats due to inadequate cooling. Some of the cooling air flowing through the tip region serpentine flow channels 24 is discharged through trailing edge cooling slots or holes 26 to provide cooling for this section of the blade, the serpentine flow channels 24 and the tip cooling slots 26 provides for a very high effective cooling for this section of the blade because of the change in forward to aft flow direction and the slots. The remaining cooling air then flows into the second and third legs 22 and 23 to provide cooling for the mid-chord section and the trailing edge region of the blade before discharging out from the trailing edge exit slots 25 to provide cooling for the remaining section of the trailing edge region of the blade.

I claim:

1. A turbine rotor blade comprising:

an airfoil extending from a root and a platform;

a leading edge region and a trailing edge region;

a pressure side wall and a suction side wall;

a blade tip region;

a main serpentine flow cooling circuit with a first leg located in the leading edge region and a last leg located in the trailing edge region;

a mini serpentine flow cooling circuit located between the first leg and a second leg of the main serpentine flow cooling circuit and in the blade tip region;

a trailing edge cooling air exit slot connected to the mini serpentine flow cooling circuit;

a row of exit slots in the trailing edge region and connected to the last leg of the main serpentine flow cooling circuit; and, the last leg of the main serpentine flow cooling circuit ends just below the mini serpentine flow cooling circuit.

2. A turbine rotor blade comprising:

an airfoil extending from a root and a platform;

a leading edge region and a trailing edge region;

a pressure side wall and a suction side wall;

a blade tip region;

a multiple pass serpentine flow cooling circuit with a first leg located in a forward section of the airfoil and a last leg located adjacent to a trailing edge region of the airfoil;

a mini-serpentine flow cooling circuit connected between the first leg and the last leg of the multiple pass serpentine flow cooling circuit;

the mini-serpentine flow cooling circuit being located in the blade tip region and extends to the trailing edge of the airfoil;

a plurality of first exit holes connected to the mini-serpentine flow cooling circuit and opening onto the trailing edge of the airfoil; and, a plurality of second exit holes connected to the last leg of the multiple pass serpentine flow cooling circuit and opening onto the trailing edge of the airfoil.

3. The turbine rotor blade of claim 2, and further comprising:

the multiple pass serpentine flow cooling circuit includes legs that extend in a spanwise direction of the airfoil; and, the mini-serpentine flow cooling circuit includes legs that extend in a chordwise direction of the airfoil.

4. The turbine rotor blade of claim 2, and further comprising:

the leading edge region is without any film cooling holes.

* * * * *